US010117493B2

(12) United States Patent
Byrd

(10) Patent No.: US 10,117,493 B2
(45) Date of Patent: Nov. 6, 2018

(54) ANETRAS KOOL HEAD DRYER COVER

(71) Applicant: Anetra Diane Byrd, Saint Petersburg, FL (US)

(72) Inventor: Anetra Diane Byrd, Saint Petersburg, FL (US)

(73) Assignee: Anetra Byrd, St. Pete, FL (US)

( * ) Notice: Subject to any disclaimer, the term of this patent is extended or adjusted under 35 U.S.C. 154(b) by 0 days.

(21) Appl. No.: 15/266,916

(22) Filed: Sep. 15, 2016

(65) Prior Publication Data

US 2018/0070696 A1 Mar. 15, 2018

(51) Int. Cl.

| | |
|---|---|
| ***A45D 20/42*** | (2006.01) |
| ***A45D 20/18*** | (2006.01) |
| ***D05B 23/00*** | (2006.01) |
| ***D05B 93/00*** | (2006.01) |

(52) U.S. Cl.

CPC ..... *A45D 20/42* (2013.01); *A45D 20/18* (2013.01); *D05B 23/00* (2013.01); *D05B 93/00* (2013.01)

(58) Field of Classification Search

CPC ..... A45D 20/00–20/24; A45D 2020/065–2020/245; D05B 23/00; D05B 93/00

USPC ..... D6/335

See application file for complete search history.

(56) References Cited

U.S. PATENT DOCUMENTS

| | | | | | |
|---|---|---|---|---|---|
| 2,205,972 | A * | 6/1940 | Davis | A45D 20/42 | 2/174 |
| 2,263,418 | A * | 11/1941 | Ganim | A42B 1/041 | 2/174 |
| 2,290,455 | A * | 7/1942 | Cook | A45D 44/12 | 34/99 |
| 2,863,365 | A * | 12/1958 | Piazze | B31B 70/00 | 383/75 |
| 3,043,016 | A * | 7/1962 | Miller | A45D 20/18 | 34/99 |
| 5,887,357 | A * | 3/1999 | McNair | A45D 20/00 | 34/99 |
| 6,212,790 | B1 * | 4/2001 | Stetson | A45D 20/12 | 34/103 |
| 8,230,615 | B1 * | 7/2012 | Fletcher | A45D 20/00 | 34/283 |
| 2012/0278968 | A1 * | 11/2012 | Bowens | A45D 20/18 | 2/171.2 |
| 2015/0149115 | A1 * | 5/2015 | Belt | A41D 13/065 | 702/166 |

FOREIGN PATENT DOCUMENTS

CA 2080805 A * 4/1994

* cited by examiner

*Primary Examiner* — Ismael Izaguirre

(57) ABSTRACT

The Salon Hair dryer Hood Cover was invented by taking a bath towel and poly cotton blend material, placing them together and cutting them 3 ft and 8 in long and 2 ft wide; Cut the covers off the towel, pin together fold down 1 in, stitching together, Slide the elastic through the corners, creating the hood. Attach your strap to the hood, which are used to tighten the hood around the salon hair dryer. This will keep the heat inward. Thus eliminating longer dryer time under the hair dryer. Attach four straps to hood, which are used to tighten the hood around the salon hairdryer This will keep the heat inward. Thus eliminating longer dryer time under the hair dryer.

1 Claim, 11 Drawing Sheets

ANETRAS KOOL HEAD DRYER COVER

FIELD OF THE INVENTION

The disclosure relates to a method of making a cover that goes over the top dome hood of a salon professional hair dryer.

BACKGROUND OF THE INVENTION

In the beauty industry, one main problem lies in the dome of the professional salon hair dryer. The hot air for drying hair escapes from the dome and goes all over the customer's neck and forehead. Thus, it takes women a long time to dry their hair and energy is wasted. While one can place a towel over the dome, this is not a good solution because the shape of the dome and the blowing air will not allow the towel to stay in place.

SUMMARY OF THE INVENTION

The solution to the problem is shown by my invention. A dryer hood cover, secured by straps onto the dome of the hair dryer. The cover maintains the heat within the dome of the dryer. The dryer cover is made in the manner described below.

BRIEF DESCRIPTION OF THE DRAWINGS

The drawings shows the parts of the dryer hood cover and how the various parts are assembled.

DETAILED DESCRIPTION OF THE INVENTION

Figure 1:
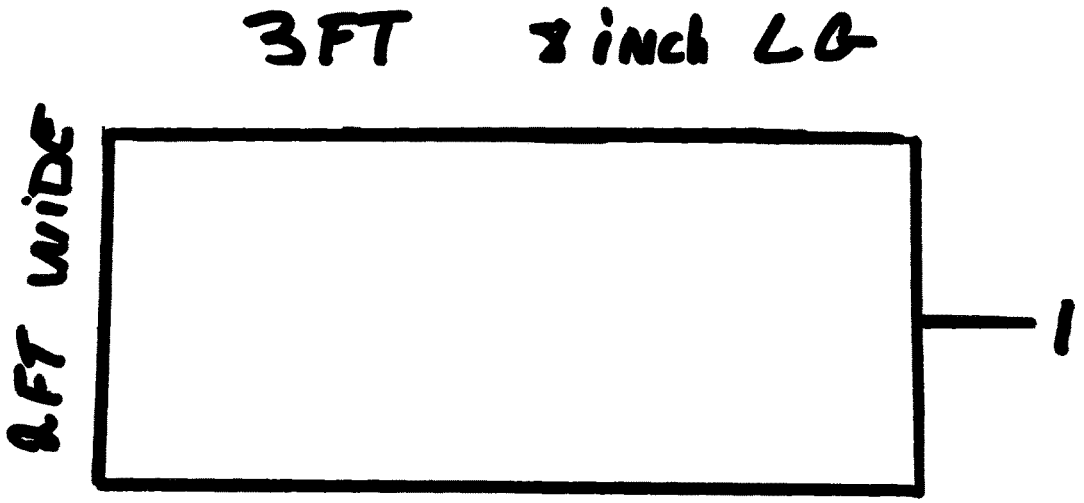
FIG. 1 is a portion of the inner cover.
Figure 2:
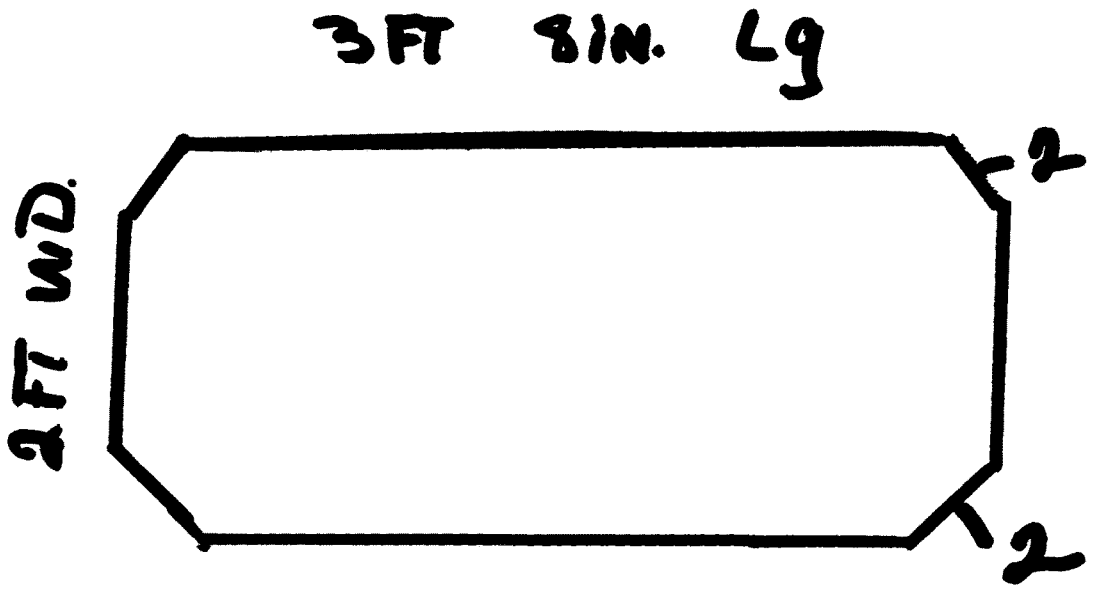
FIG. 2 is a view of the inner cover with four corners cut off.
Figure 3:
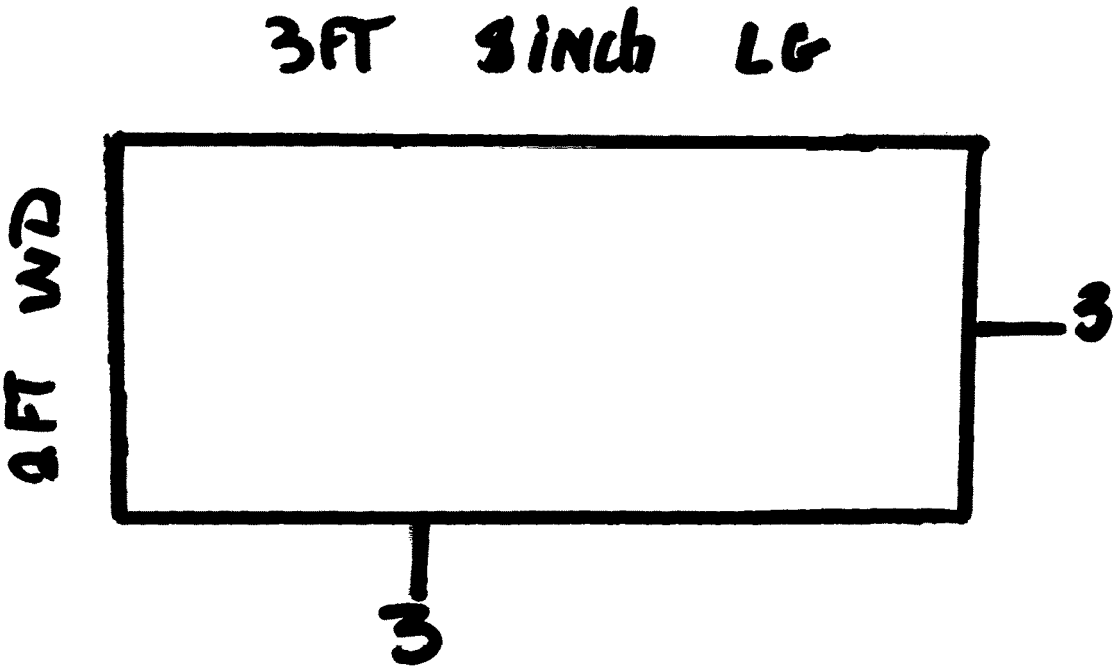
FIG. 3 is a view of the outer cover.

FIG. 1 Shows the inner cover 1 for the dryer cover. It is a sheet of material 2 ft. wide by 3 ft. 8 inches. Preferably, it is a towel. The dimensions may be adjusted to create a larger or smaller cover and the invention is not limited to a particular dimension. In the next step, FIG. 2, the four corners 2 of the inner cover are cut off. The inner cover is attached to an outer cover 3 with about the same dimensions of the inner cover before the corners are cut off. Shown in FIG. 3. Preferably, the outer cover has a decorative design, but this is not necessary.

Figure 4:
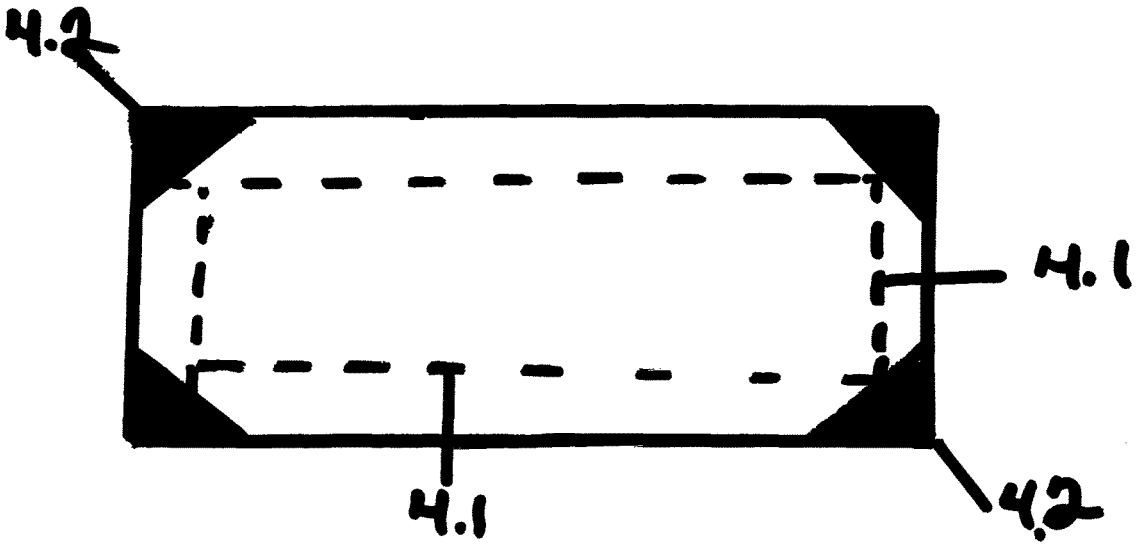
FIG. 4 is a view of the inner and outer cover stitched together.
Figure 5:
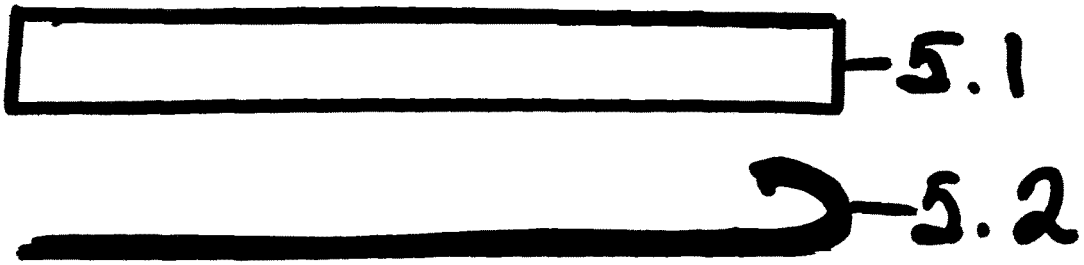
FIG. 5 is a view of the elastic for securing the cover and a hook used in the assembly process.

FIG. 4 Shows the attachment of the inner cover to the outer cover by stitches 4.1. The stitches are about 1 inch from the edges of the covers. It is important that the stitches do not extend into the corners. A second stitch is made at the edge of the covers such that the first and second stitches creates a pocket 6.1 for threading the elastic material.

Figure 6:
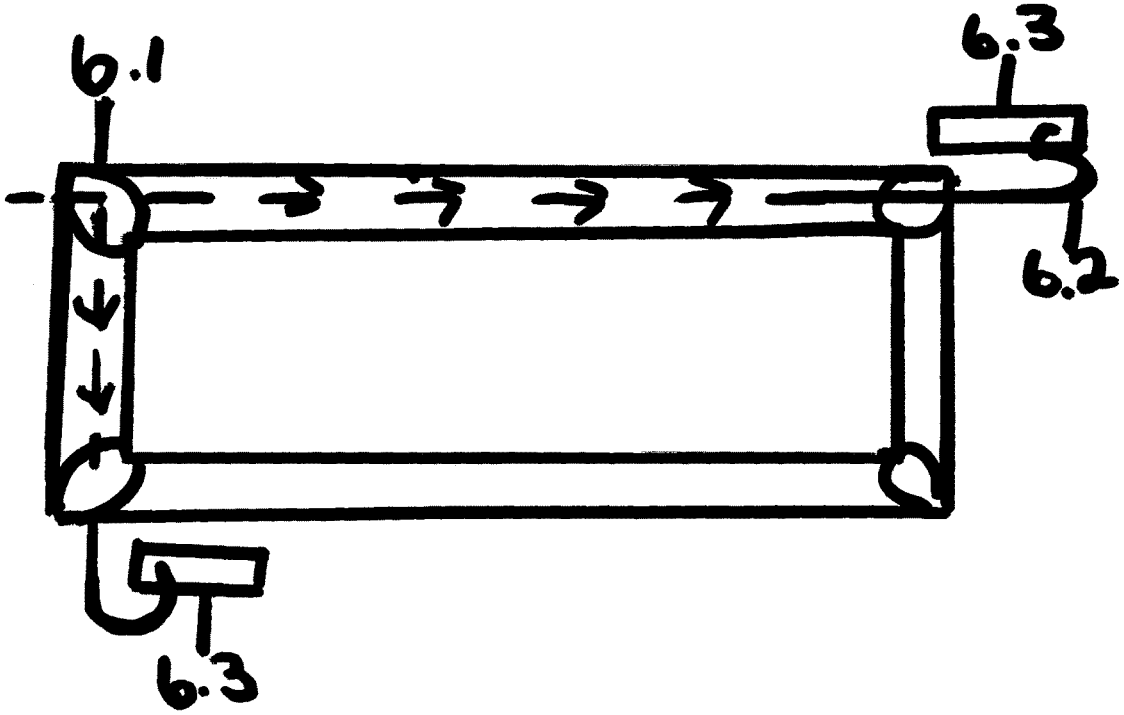
FIG. 6 shows the use of the hook to thread the securing straps through the inner and outer covers.
Figure 7:
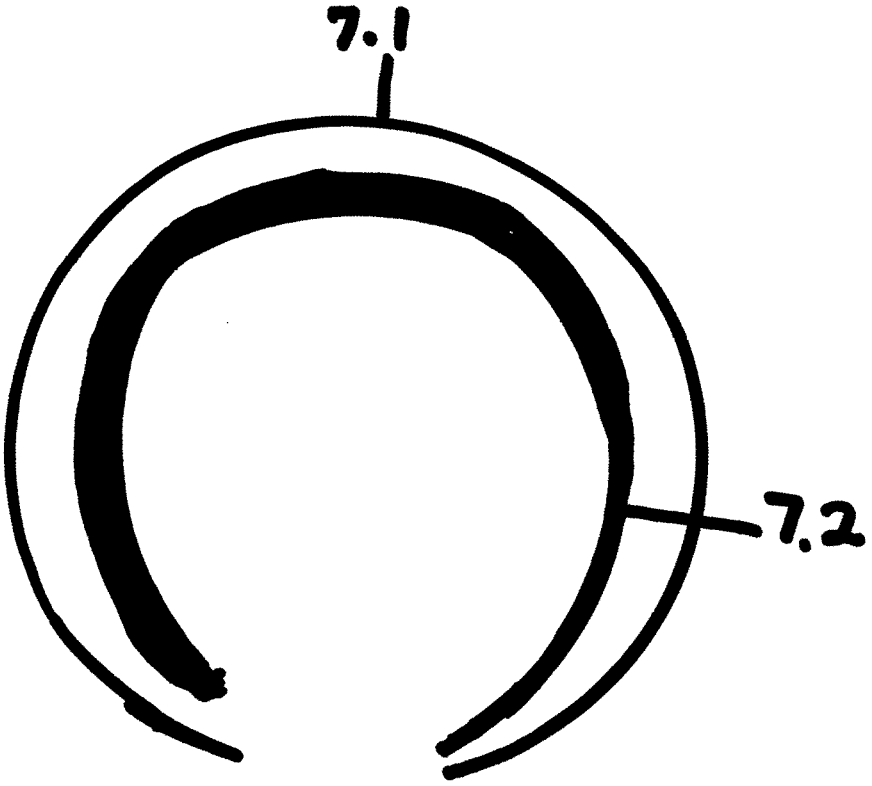
FIG. 7 is a view of the hood cover when it is placed on the dryer.
Figure 8:
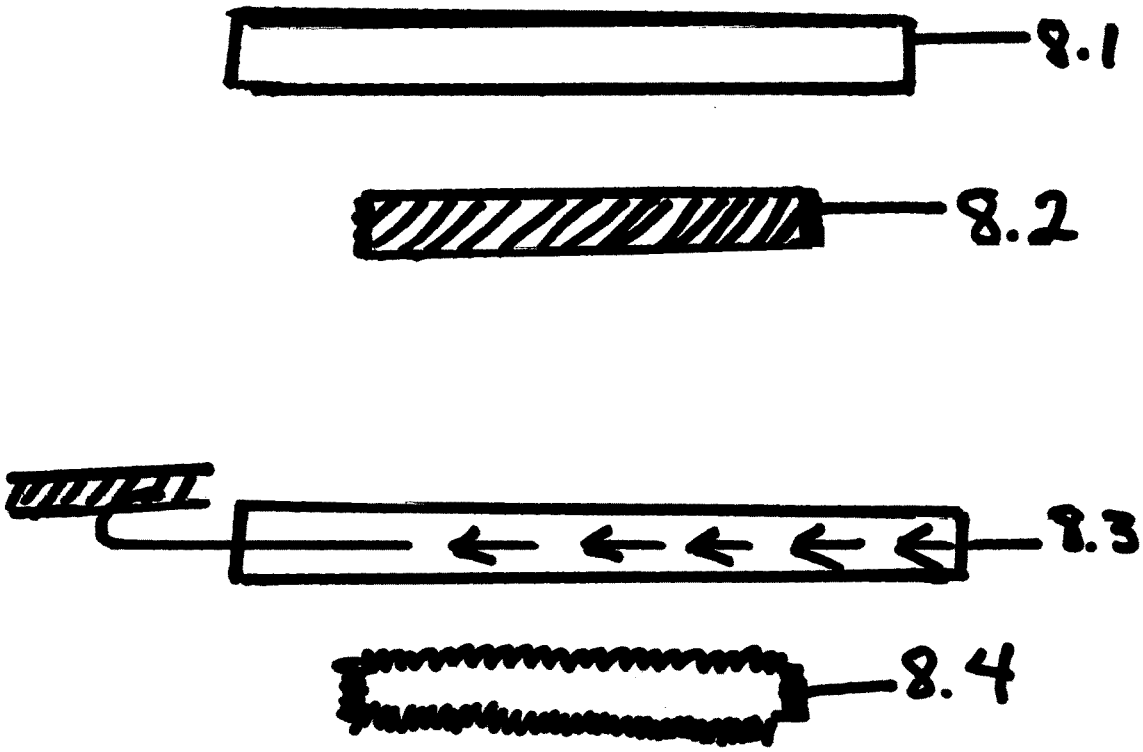
FIG. 8 shows the making of one of the securing straps.
Figure 9:
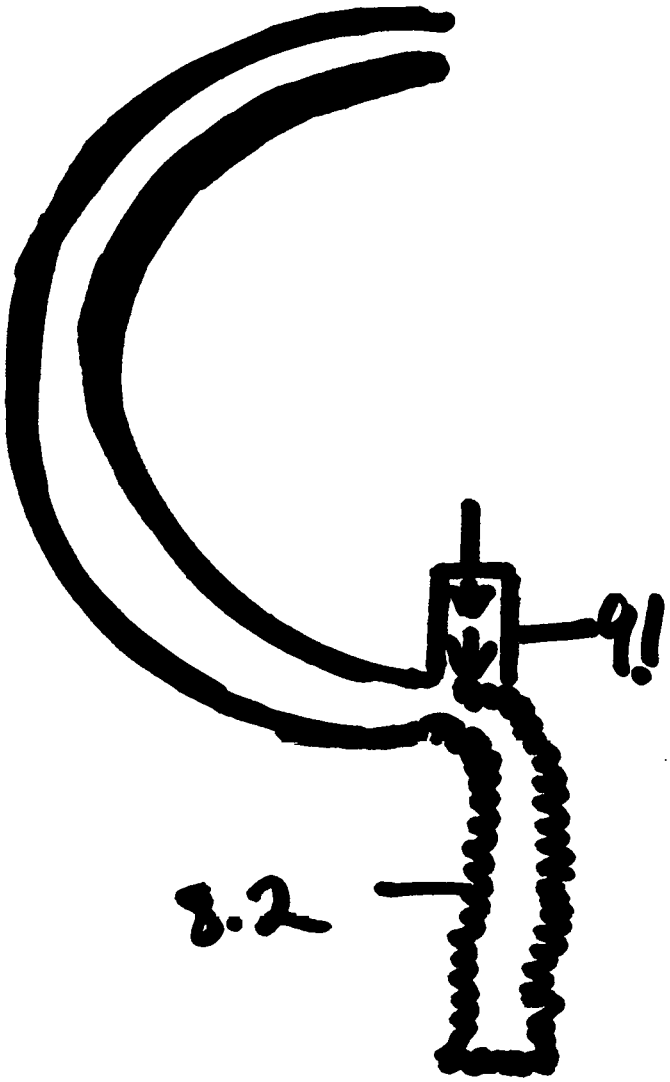
FIG. 9 shows attaching one of the straps.

Now you will attach the elastic material 5.1. The elastic material 5.1 is about an inch wide and has a length shorter than the length of one side of the cover. You need one piece of elastic material for each side. A hook hanger 5.2 is needed to thread the elastic material through the pockets 6.1. First thread the hook hanger through one side of the cover so it goes in one pocket and comes out another pocket. Attach the hook hanger to the edge 6.3 of the elastic material. Pull the hook hanger in the opposite direction of the arrows in FIG. 6 to pull the elastic material through the pocket. Sew one end of the elastic material to the cover at the first pocket opening, stretch the elastic material using the hook anger and sew the other end to the pocket opening on the other end of the cover. Repeat for each side of the cover. Because the elastic material is stretched when it is sewn to the cover it will retract into its original shape. The retracting elastic material causes the cover to assume a spherical shape as shown in FIG. 7. The outer cover surface is shown as 7.1 and the inner cover surface is 7.2.

Figure 10:
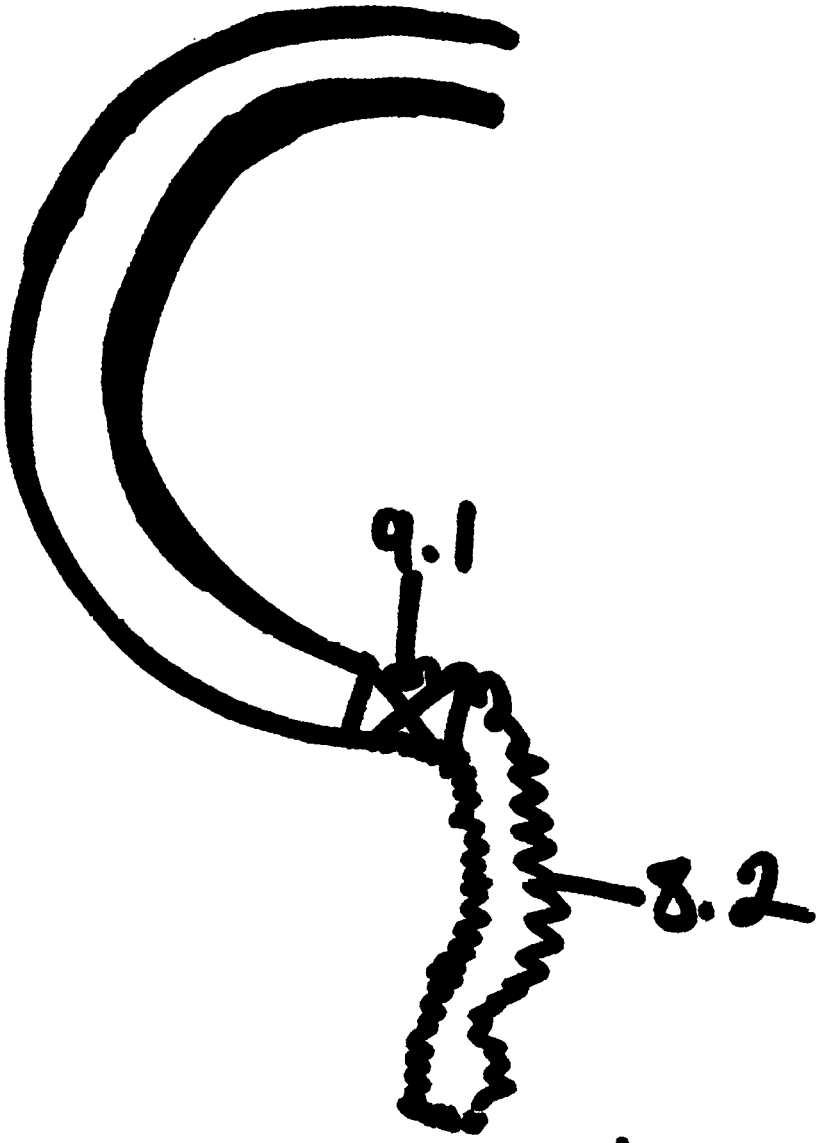
FIG. 10 shows sewing one of the straps to the cover.
Figure 11:
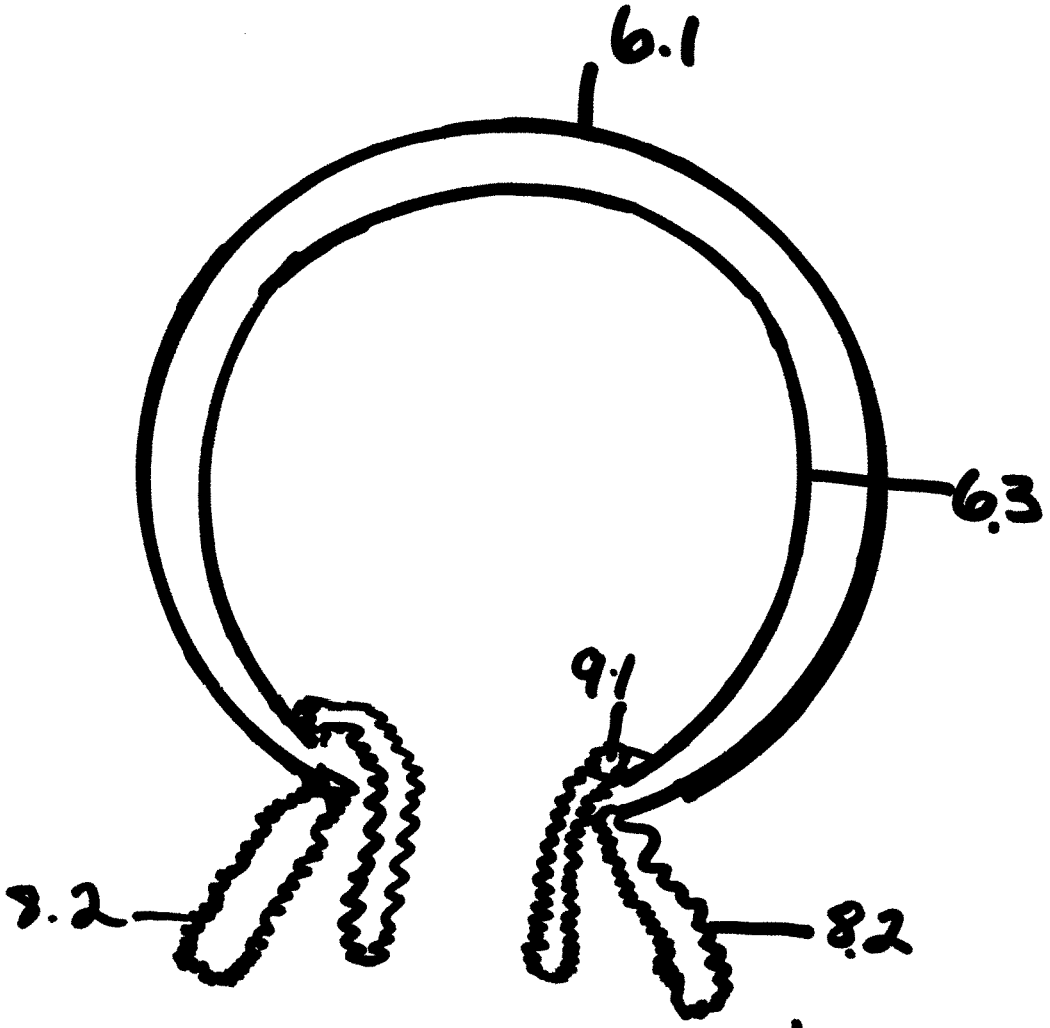
FIG. 11 shows the completed cover with four straps.

Now we will create the straps. Start with a length of fabric of the desired length and form a tube 8.1. This can be done by folding the material and sewing the loose sides together. A piece of rope yarn 8.2 is threaded through the inside of the tube 8.3 by the hook hanger. Make the fabric of the straps longer than the yarn. When the yarn is entirely inside the fabric is will be a crinkly strap 8.4 because the fabric is longer than the yarn. Make 4 straps the same way. Sew one side of each crinkly strap to the cover near each of the pocket openings 9.1. This is shown in FIG. 10. The completed dryer cover is shown in FIG. 11.

I claim:

1. A method of making a cover for a dome hair dryer, comprising;

Providing an inner cover with a rectangular dimension suitable for covering the dome of the hairdryer;

Cut four corners off of the inner cover;

Provide an outer over with dimension similar to the inner cover before the corners have been cut off;

Attach the inner cover to the outer cover with two paralled stitches on the outer edge of the covers wherein the stitches from a pocket on each side while leaving the corners free;

Thread a hanger through each pocket;

Attach an elastic material through the pocket with the hanger hook;

Sew the end of elastic material not connect to hanger hook to the first end product;

Stretch elastic material so the other end of elastic material is outside the second end of the pocket; cutting all excess elastic off each end; and repeat all four sides;

Thread a piece of yarn through a sleeve to form strap; and attach one end strap to each of the four corners thread a piece of yarn through a sleeve to form a strap; and repeat to form four straps;

Attach one end strap to each of the four corners of the outer cover.

* * * * *